US007766404B2

(12) United States Patent
Butterfield

(10) Patent No.: US 7,766,404 B2
(45) Date of Patent: Aug. 3, 2010

(54) EASY RELEASE CORN COB HOLDER

(76) Inventor: Yvonne Marie Butterfield, 3 Park Dr., W., Circel Pines, MN (US) 55014

( * ) Notice: Subject to any disclaimer, the term of this patent is extended or adjusted under 35 U.S.C. 154(b) by 0 days.

(21) Appl. No.: 12/425,916

(22) Filed: Apr. 17, 2009

(65) Prior Publication Data

US 2009/0261606 A1 Oct. 22, 2009

Related U.S. Application Data

(60) Provisional application No. 61/124,571, filed on Apr. 18, 2008.

(51) Int. Cl.
*A47G 19/00* (2006.01)
*A47G 19/30* (2006.01)
*A47G 21/00* (2006.01)

(52) U.S. Cl. ..... 294/5

(58) Field of Classification Search ..... 294/5, 294/50, 8, 61, 110.1, 110, 2; 99/419, 532; D7/683, 684
See application file for complete search history.

(56) References Cited

U.S. PATENT DOCUMENTS

| | | | | |
|---|---|---|---|---|
| 201,230 | A | | 3/1878 | De Yongh |
| D26,777 | S | | 3/1897 | Donnely |
| 693,284 | A | | 2/1902 | Lemon |
| 2,500,647 | A | * | 3/1950 | Schulthess ..... 294/61 |
| 3,082,681 | A | * | 3/1963 | Petersen ..... D7/683 |
| 3,596,966 | A | * | 8/1971 | Shredl ..... 294/61 |
| 3,956,989 | A | | 5/1976 | Sallade et al. |
| 3,995,902 | A | | 12/1976 | Sciaino |
| 4,163,575 | A | | 8/1979 | Riedinger |
| D306,114 | S | | 2/1990 | Moll |
| 5,088,782 | A | | 2/1992 | Scott |
| D331,525 | S | | 12/1992 | Anderson |
| 5,193,871 | A | * | 3/1993 | Williams ..... 294/61 |
| D374,593 | S | | 10/1996 | Eggert |
| 6,012,749 | A | | 1/2000 | Farber |
| D426,115 | S | | 6/2000 | Budd |
| 6,270,132 | B1 | | 8/2001 | Kretschmer |
| D470,729 | S | | 2/2003 | Kotsonis |
| D497,293 | S | | 10/2004 | Cheng |

* cited by examiner

*Primary Examiner*—Paul T Chin
(74) *Attorney, Agent, or Firm*—Roger Belfay

(57) ABSTRACT

The Easy Release Corn Cob Holder comprises: an exterior shell having a hollow core, said hollow core extending the full length of said exterior shell, an interior Plunger, and a plurality of Tines. The exterior shell may be fitted with a rim to aid the user in exerting a force on the exterior shell.

2 Claims, 6 Drawing Sheets

EASY RELEASE CORN COB HOLDER

CROSS REFERENCE TO RELATED APPLICATIONS

The application listed below is the only application related to this application. This application claims benefit of the earlier filing date under 35 USC 119(e) of provisional application No. 61/124,571 filed on Apr. 18, 2008

The Easy Release Corn Cob Holder is a corn cob holder comprising: an exterior shell having a first end, a second end, and a hollow core, said hollow core extending the full length of said exterior shell, an interior Plunger, said Plunger having a shape conforming to said hollow core, with said Plunger slideably fitted within said hollow core, and a plurality of Tines protruding from said first end of said exterior shell.

The exterior shell may be constructed of any material capable of retaining a number of tines and maintaining the shape of a hollow core when the temperature of said exterior shell is elevated to temperatures ordinarily experienced when boiling corn or other food objects.

The Plunger is formed of any suitable material shaped fit within the hollow core of the exterior shell, said Plunger preferably being longer than the hollow core of the exterior shell.

STATEMENT REGARDING FEDERAL SPONSORSHIP

No invention claimed in this application was made under Federally sponsored research or development.

BACKGROUND OF INVENTION

The use of handles for holding corn and other food items is well known in the art. The attachment, retention, and removal of the handles are three objectives of all devices developed for the purpose of holding corn and other food items. These three design objectives present conflicting challenges. The trade-offs among these objectives are the key to a successful corn holding apparatus.

The use of a handle and tines configuration is illustrated by U.S. Pat. No. 201,230 to De Yongh, and D26,777 to Donnely.

In some cases decorative and even humorous handles has been employed as in U.S. Pat. No. 6,012,749 to Farber, et al, and U.S. Pat. No. D426,115 to Budd.

In another class of holders the tines are configured to maximize retention as in U.S. Pat. No. 3,995,902 to Sciaino, U.S. Pat. No. 4,163,575 to Riedinger, Jr., et al., U.S. Pat. No. 5,088,782 to Scott, and U.S. Pat. No. D374,593 to Eggert In yet another class of inventions the basic handle is augmented with additional features as shown in U.S. Pat. No. 3,956,989 to Featherstonhugh, U.S. Pat. No. 6,270,132 to Kretschmer, U.S. Pat. No. 693,284 to Lemon, and U.S. Pat. No. D497,293-Cheng, et al.

Another class of improvements aimed at improving the user's grip on the handles is demonstrated by U.S. Pat. D306, 114 to Moll, U.S. Pat. No. D331,525 to Anderson, and U.S. Pat. No. D470,729 to Kotsonis.

The present invention is intended to provide easy attachment, adequate retention capability and facilitate removal of the holder following use by providing a plunger to aid in disengaging the holder from the Corn or other food item.

BRIEF SUMMARY OF THE INVENTION

The Easy Release Corn Cob Holder is a corn cob holder comprising: an exterior shell having a first end, a second end, and a hollow core, said hollow core extending the full length of said exterior shell, an interior Plunger, said Plunger having a shape conforming to said hollow core, with said Plunger slideably fitted within said hollow core, and a plurality of Tines protruding from said first end of said exterior shell.

The exterior shell may be constructed of any material capable of retaining a number of tines and maintaining the shape of a hollow core when the temperature of said exterior shell is elevated to temperatures ordinarily experienced when boiling corn or other food objects. A number of Tines are embedded in the exterior shell at the first end to permit the user to pierce a corn cob or other food object by the Tines and thereby permit the user to lift the corn cob or other food object. The exterior shell is provided with a hollow core of any suitable shape to permit passage of a Plunger therethrough to assist in removal of the exterior shell and tines from the corn cob or other food object.

The Plunger is formed of any suitable material shaped fit within the hollow core of the exterior shell, said Plunger preferably being longer than the hollow core of the exterior shell. It will be readily appreciated that the Plunger may be composed of one or more parts provided that the Plunger's overall length exceeds that of the shell's hollow core. The Plunger's overall shape provides a surface which contacts the corn cob or food object at one end, and the user's fingers at the other and generally conforms to the shape of the hollow core of the shell along the Plunger's length.

DETAILED DESCRIPTION

Figure 1:
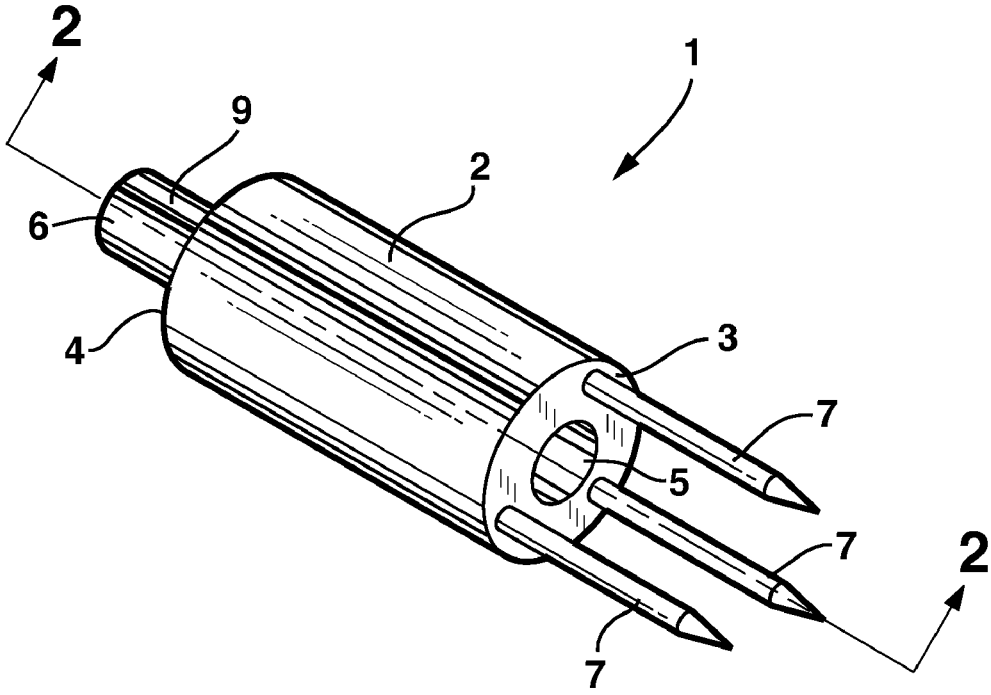
FIG. 1 is a perspective view of the corn holder.
Figure 2:
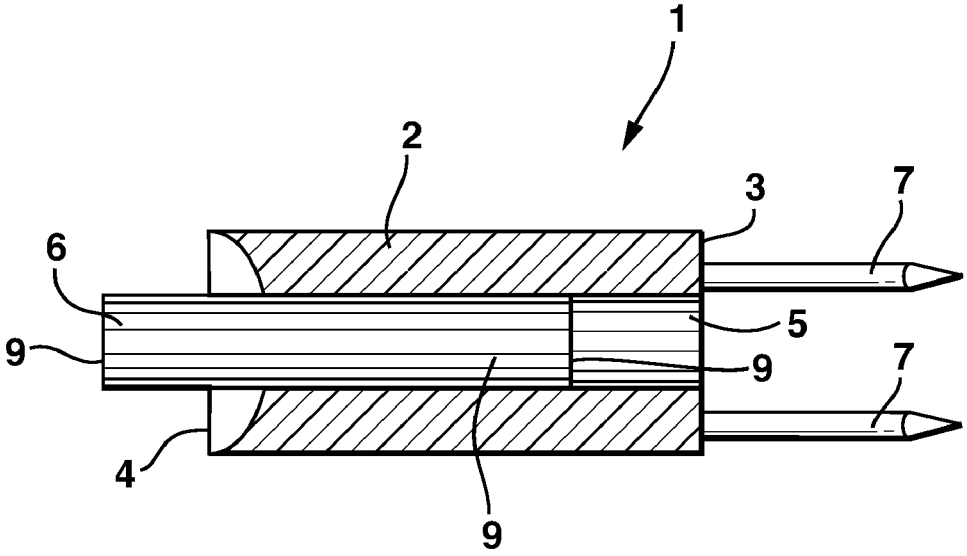
FIG. 2 is a section view of FIG. 1.
Figure 3:
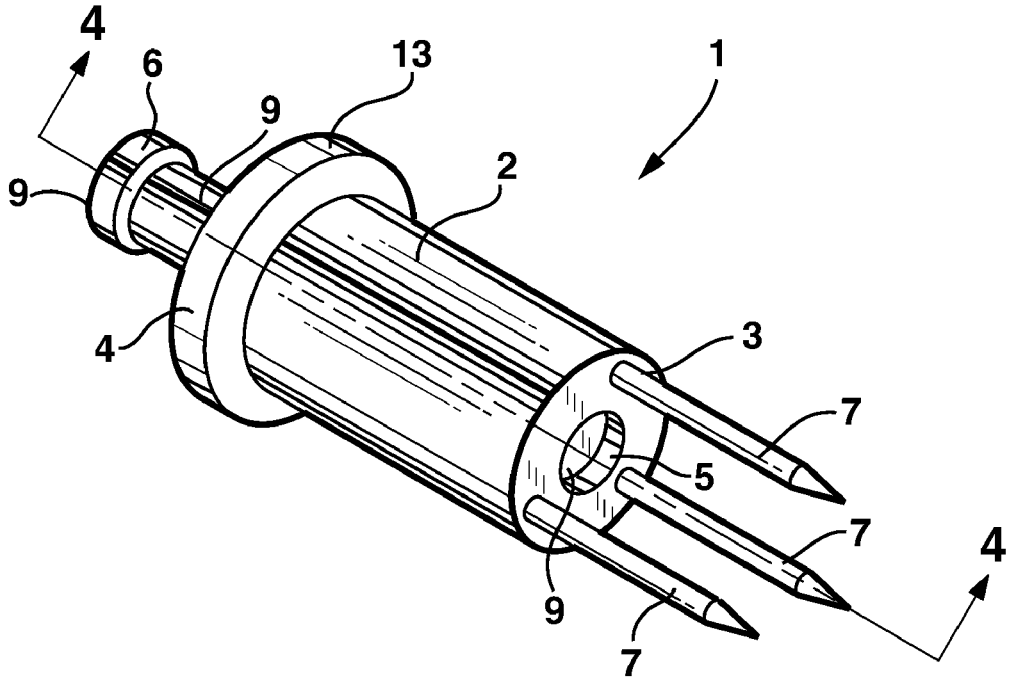
FIG. 3 is a perspective view of an embodiment.
Figure 4:
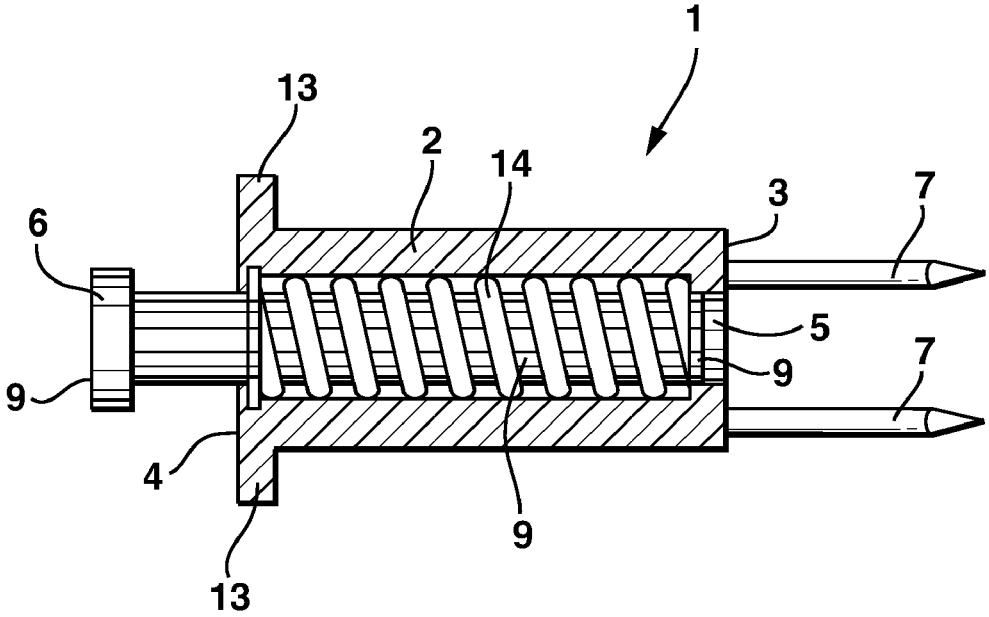
FIG. 4 is a section view of FIG. 3.
Figure 5:
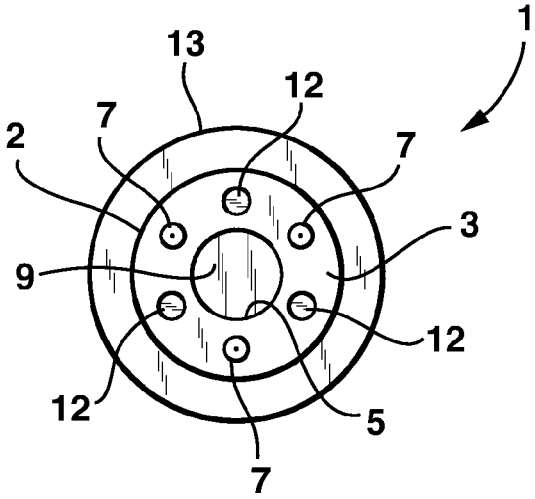
FIG. 5 is an end view of another embodiment.
Figure 6:
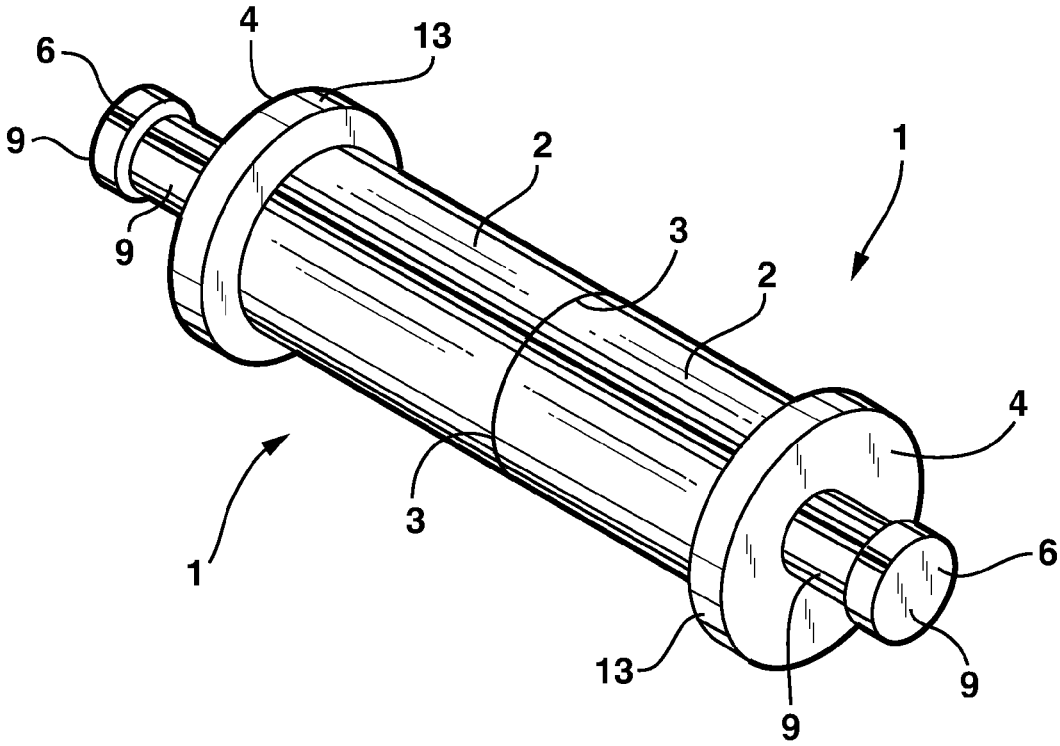
FIG. 6 is a perspective view of a storage mode.
Figure 7:
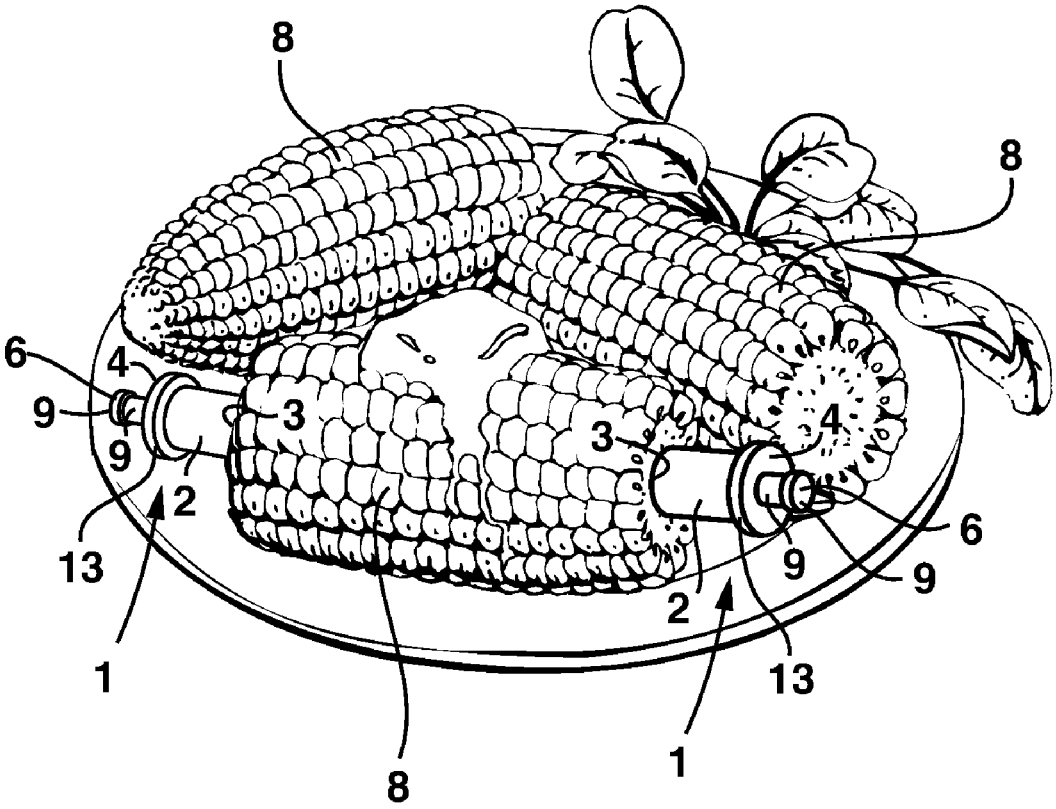
FIG. 7 is a perspective view of an embodiment in use.
Figure 8:
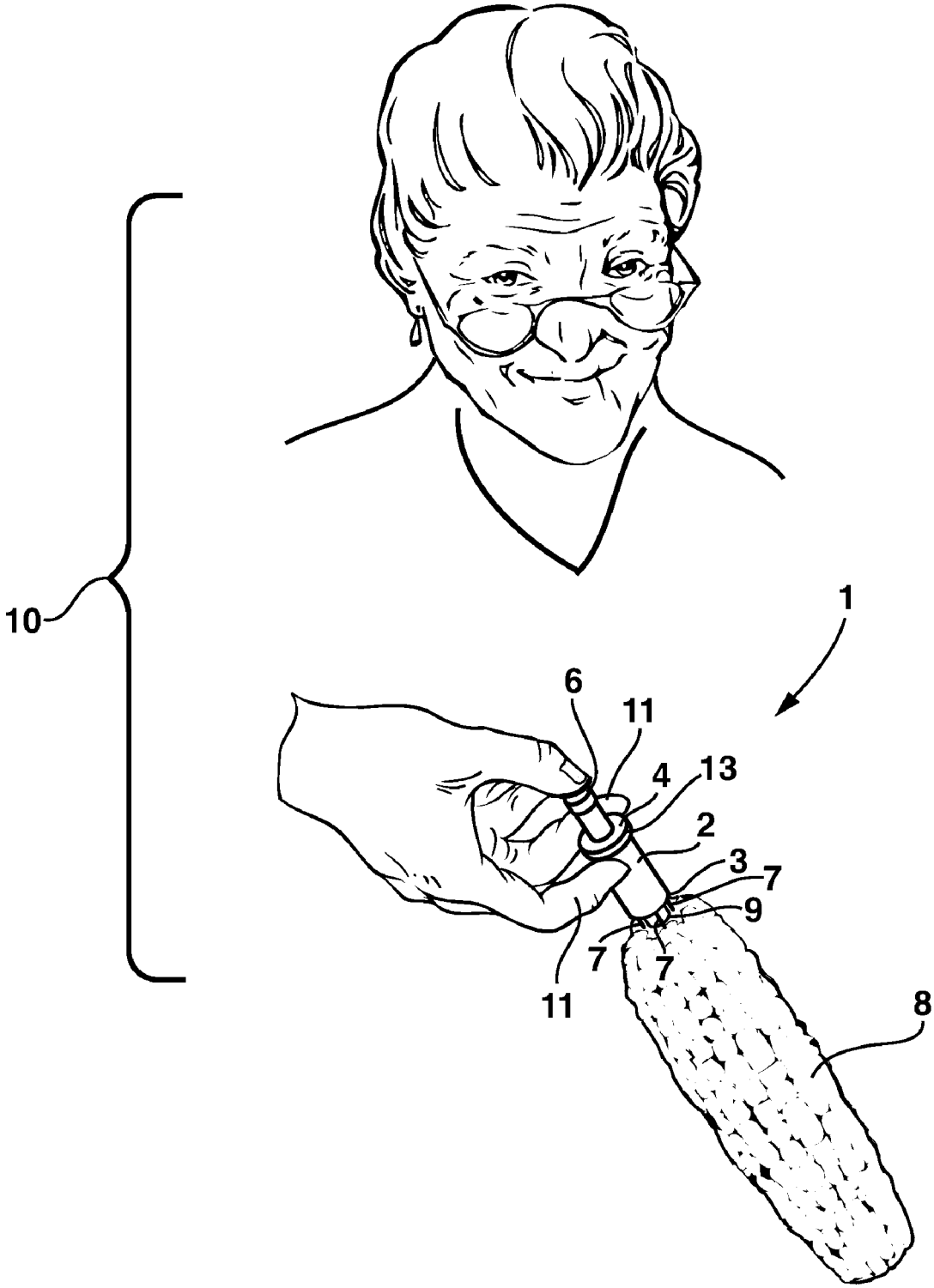
FIG. 8 is a perspective view of a method of use.
Figure 9:
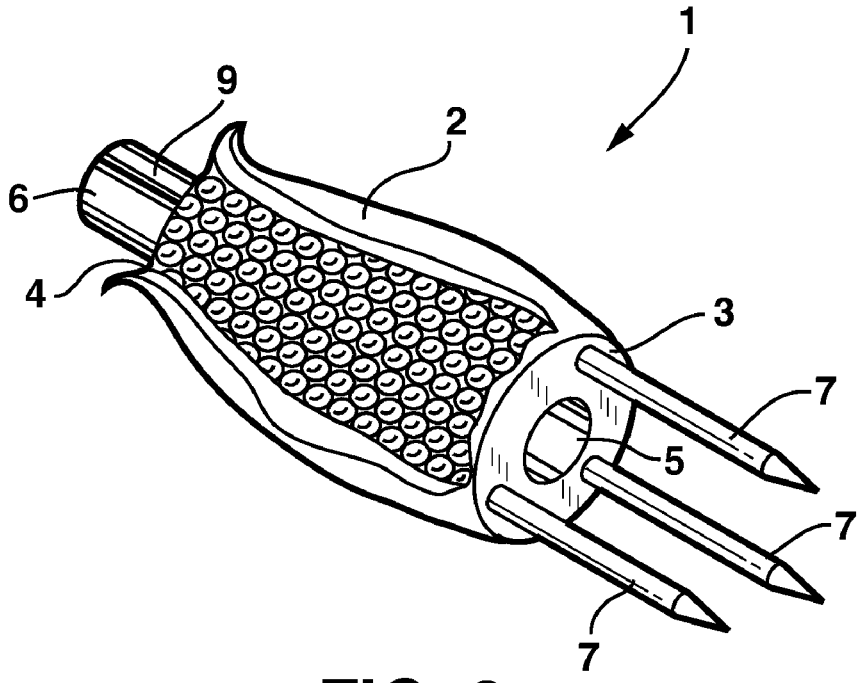
FIG. 9 is a perspective view of another embodiment.
Figure 10:
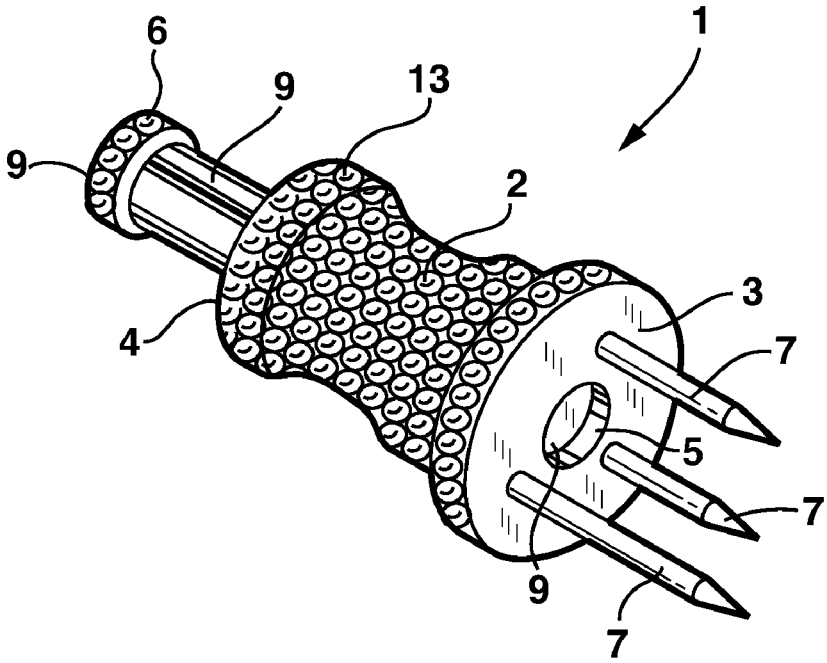
FIG. 10 is a perspective view of another embodiment.

The Easy Release Corn Cob Holder 1 is a corn cob holder 1 comprising: an exterior shell 2 having a first end 3, a second end 4, and a hollow core 5, said hollow core 5 extending the full length of said exterior shell 2, an interior Plunger 6, said Plunger 6 having a shape conforming to said hollow core 5, with said Plunger 6 slideably fitted within said hollow core 5, and a plurality of Tines 7 protruding from said first end 3 of said exterior shell 2.

The exterior shell 2 may be constructed of any material capable of retaining a number of tines 7 and maintaining the shape of a hollow core 5 when the temperature of said exterior shell 2 is elevated to temperatures ordinarily experienced when boiling corn or other food objects 8. A number of Tines 7 are embedded in the exterior shell 2 at the first end 3 to permit the user 10 to pierce a corn cob or other food object 8 by the Tines 7 and thereby permit the user 10 to lift the corn cob or other food object 8. The exterior shell 2 is provided with a hollow core 5 of any suitable shape to permit passage of a Plunger 6 therethrough to assist in removal of the exterior shell and tines 7 from the corn cob or other food object 8.

The Plunger 6 is formed of any suitable material shaped fit within the hollow core 5 of the exterior shell 2, said Plunger 6 preferably being longer than the hollow core 5 of the exterior shell 2. It will be readily appreciated that the Plunger 6 may be composed of one or more parts provided that the Plunger's 6 overall length exceeds that of the shell's hollow core 5. The Plunger's 6 overall shape provides a surface 9 which contacts the corn cob or food object 8 at one end, and the user's 10 fingers 11 at the other and generally conforms to the shape of the hollow core 5 of the shell along the Plunger's 6 length.

To attach the Easy Release Corn Cob Holder 1 to a corn cob or other food object 8, the use 10 grasps the exterior shell 2 and pushes the tines 7 into the corn cob or other food object 8.

To detach the Easy Release Corn Cob Holder 1 from the corn cob or other food object 8, the user 10 pushes the Plunger 6 toward the attached corn cob while at the same time the user 10 pulls the shell away from the corn cob or other food object 8. This removal operation is usually accomplished by holding the shell between the user's 10 index and middle fingers and pressing on the Plunger 6 with the thumb. This action causes the Plunger 6 to exert a force upon the corn cob or other food object 8 and an opposite force to be exerted on the Tines 7 by the exterior shell 2. The result is the easy removal of the Easy Release Corn Cob Holder 1 from the Corn Cob or other food object 8 without the necessity of the user making direct contact with the Corn Cob or other food object 8.

The use of a pair of Easy Release Corn Cob Holders 1 greatly facilitates holding the Corn Cob or other food object 8, but in many cases a single Easy Release Corn Cob Holder 1 will suffice.

In another embodiment the shell is provided with a number of recesses 12 in the first end 3 corresponding in position to the tines 7 of another Easy Release corn Cob Holder 1 with such recesses 12 sized to accommodate the Tines 7 of the other Easy Release Corn Cob Holder 1. The recesses 12 may be of any diameter and depth to permit a pair of Easy Release corn cob holders 1 to be placed together with the tines 7 of each holder 1 at least partially inserted into the recesses 12 of the other. However, it will be appreciated that recesses 12 with a depth equal to or greater than the exposed length of the Tines 7 will provide the closest proximity of the two Easy Release Corn Cob Holders 1 and thereby minimize required storage space. Further, the diameter of the recesses 12 may be sized to provide retention force on the Tines 7 to assure that easy release corn cob holders 1 do not become easily separated.

The second end 4 of the exterior shell 2 of the Easy Release Corn Cob Holder 1 may be fitted with a rim 13 to aid the user 10 in exerting a force on the exterior shell 2.

The Easy release Corn Cob Holder 1 may also be provided with a spring 14 connecting the exterior shell 2 and Plunger 6. Said spring 14 may be designed to draw the Plunger 6 toward the Corn Cob or other food object 8, away from the Corn Cob or other Food object 8, or to hold the Plunger 6 and exterior shell 2 in a predefined relationship, or any combination of these purposes.

I claim:

1. A corn cob holder comprising:

a) an exterior shell having a first end, a second end, and a hollow core, said hollow core extending the full length of said exterior shell;

b) an interior plunger, said plunger having a shape conforming to said hollow core, with said plunger slideably fitted within said hollow core, the plunger of sufficient length to protrude from both the first and second end of said the exterior shell;

c) a plurality of tines protruding from said first end of said exterior shell; and d) the exterior shell further comprising a rim attached around the second end of said exterior shell, and further comprising a set of recesses in said exterior shell, said recesses positioned at said first end of said exterior shell, to accommodate insertion of the tines of another of the corn cob holder.

2. The holder of claim 1 further comprising a spring.

* * * * *